United States Patent [19]

Hendrix

[11] 4,026,289

[45] May 31, 1977

[54] VACCINATING AND BEAK-HOLDING ACCESSORY FOR A BIRD PROCESSOR

[76] Inventor: Edward M Hendrix, Rte. 2, Dentonville, Ark. 72712

[22] Filed: June 24, 1976

[21] Appl. No.: 699,266

[52] U.S. Cl. ..... 128/223; 128/253

[51] Int. Cl.[2] ..... A61D 7/00

[58] Field of Search ..... 128/253, 223, 303.1

[56] References Cited

UNITED STATES PATENTS

| | | | |
|---|---|---|---|
| 3,302,645 | 2/1967 | Lockmiller | 128/223 |
| 3,434,474 | 3/1969 | Reynolds | 128/253 |
| 3,570,487 | 3/1971 | Reynolds | 128/223 |
| 3,593,714 | 7/1971 | Lyon | 128/253 |

*Primary Examiner*—John D. Yasko

*Attorney, Agent, or Firm*—Ralph S. Branscomb

[57] ABSTRACT

The invention is an attachement or an accessory for a bird processing machine which is used primarily for trimming one or more of the beak members of the bird to prevent cannabilism, the accessory comprising a removable hollow bar member which is interchangeable in the processing machine with other slightly different accessories, the bar member serving as a support for the beak and as an anvil against which a cauterizing blade moves to trim the upper beak member, there being an oral applicator tube passing through the bar from the rear to introduce a fine stream of oral application liquid through an orifice in the bar to the bird's mouth while the upper beak member is trimmed, there being a flow of cooling fluid through the bar to prevent burning the bird's mouth and to cool the oral application.

3 Claims, 3 Drawing Figures

VACCINATING AND BEAK-HOLDING ACCESSORY FOR A BIRD PROCESSOR

BACKGROUND OF THE INVENTION

The present invention is in the field of treatment of fowl, primarily chickens and the like which are raised in large quantities on ranches, and more particularly the invention pertains to the equipment utilized to trim the birds' beaks to minimize cannabilism and to force-feed fluids to the bird for various purposes.

In the chicken raising industry, a common problem among fowl is the pecking of one fowl by another, resulting in loss of feathers which in turn results in the loss of weight of the bird due primarily to nervousness and anxiety resulting from the constant pecking. The practice of cutting and cauterizing the birds' beaks is now widespread and a machine made by Lyon Electric Company of San Diego, California, is widely used to speed the processing of the young birds. This machine was developed by James Lyon and is the subject of several patents, including U.S. Pat. No. 3,812,857 issued on May 28, 1974, which shows the basic machine having a removable attachment which provides for an adjustable beak holding orifice and has other features advantageous in certain circumstances in the bird processing procedure. The attachment in this patent is used solely for holding the beak steady while it is being trimmed and cauterized and makes no provision for vaccination, although the vaccination process has been disclosed in other patents pertaining to the machine generally.

Another related U.S. Pat. No. 3,641,998, discloses an apparatus developed by James Lyon and the present invention for the purposes of injecting fluids into fowl, and it is an object of the present invention to permit the injection of fluid into the bird's mouth rather than under the skin and replace the device of U.S. Pat. No. 3,641,998 with the present attachment on a Lyon beak trimmer.

Another machine is disclosed in U.S. Pat. No. 3,570,487 which was issued to Lamar W. Reynolds on Mar. 16, 1971. This Patent provides for the trimming and cauterizing of the upper beak member while simultaneously introducing vaccine into the bird's mouth. However, the vaccine and anvil member of the Reynold's Patent must be specially built into the basic Lyon machine and is not easily interchangeable with other accessories.

SUMMARY OF THE INVENTION

The present invention is an accessory for use on the basic Lyon bird processing machine and is easily installable and detachable therefrom so that different attachments can be used on the same machine without making difficult conversions.

The invention comprises essentially a hollow bar having a pair of vertical end flanges which are mountable by wing nuts or like easily removable means to the interior walls of the bird processing machine, this bar serving as a brace across which the bird's beak is straddled, and also as an anvil upon which the hot cauterizing blade descends to clip and cauterize the upper beak member, there being an orifice and an applicator tube leading thereto to inject fluids into the bird's mouth while the upper beak member is being cauterized. The hollow bar member is provided with a flow of cooling fluid to prevent burning the interior of the bird's mouth by the bar, which would otherwise become overheated from the cauterizing blade, and the fluid in the applicator tube, which may be vaccine.

DETAILED DESCRIPTION OF THE PREFERRED EMBODIMENT

Figure 1:
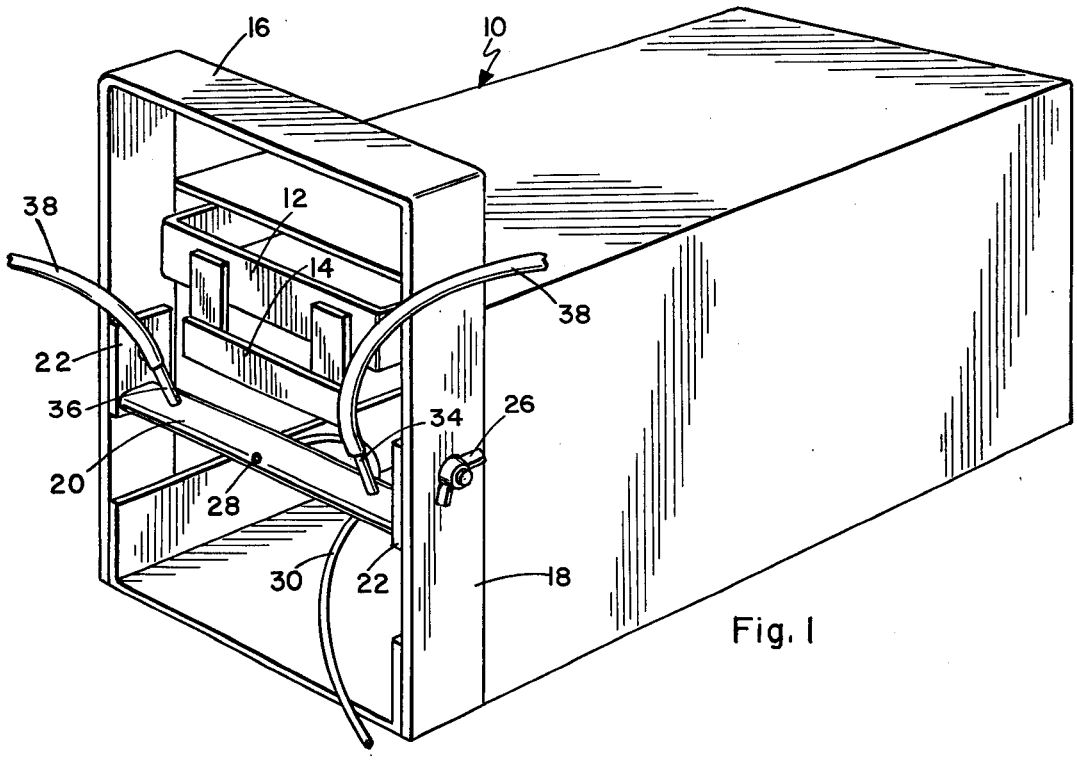
FIG. 1 is a perspective view of a typical debeaking machine with the beak support bar attached.

FIG. 1 illustrates the basic machine at 10 which has a swing support member 12 carrying a cauterization blade 14 which is electrically heated and swings downwardly on the swing member 12 to trim the end and cauterize one or both the beak members of a bird as is described more in detail in the above referenced U.S. Pat. No. 3,812,857, in which the blade is drawn across a planar beak support in scissors fashion. The machine 10 includes a frame 16 having a pair of vertical sidewalls 18 to which the beak support structure of U.S. Pat. No. 3,812,857 is mounted.

Figure 2:
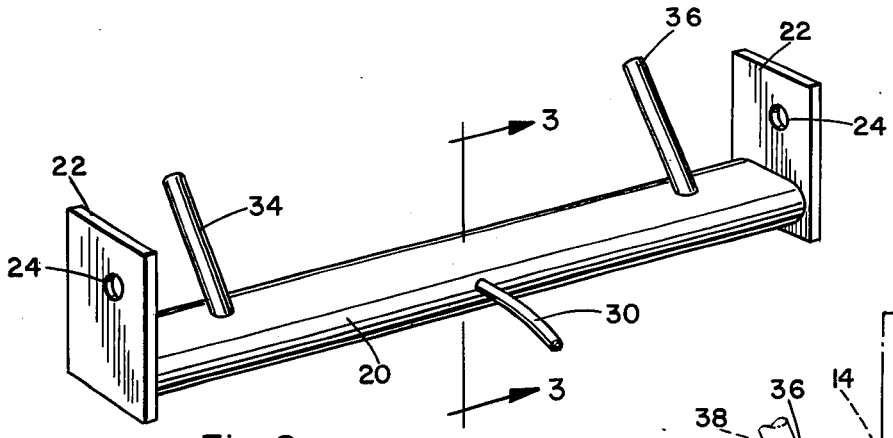
FIG. 2 is an enlarged perspective view of the beak support bar.
Figure 3:
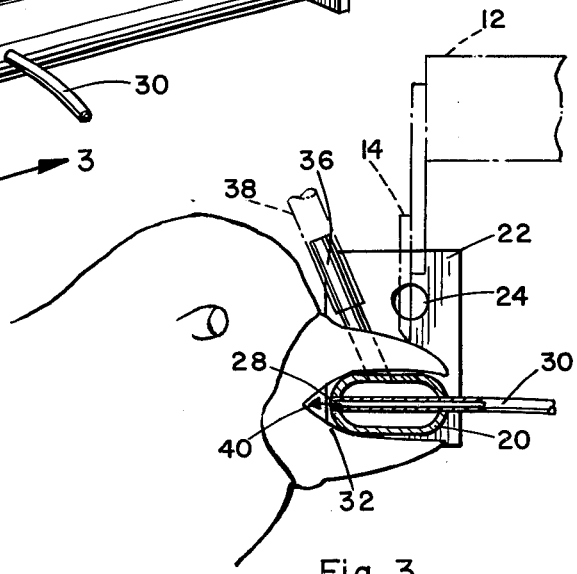
FIG. 3 is a sectional view taken on line 3—3 of FIG. 2, showing the placement of the chicken's beak for fluid feeding and cauterization.

The accessory of the instant invention which replaces the beak support structure in the above mentioned patent is best shown in FIG. 2 and includes a long bar 20 which is hollow and generally ovate in lateral cross-section which can be seen in FIG. 3. At the ends of the bar are a pair of parallel flanges 22 which are vertically oriented when the bar is mounted in the cauterizing machine. The flanges are provided with holes 24 which mate with similar holes in the vertical sidewalls of the machine frame so that wing nuts 26 may be used to easily and removably mount the bar to the machine.

As is best seen in FIG. 3, the front edge of the bar at a central longitudinal location is provided with an orifice 28 and this orifice is fed by a metallic applicator tube 30 which passes through the hollow portion of the bar from the rear as shown to deliver liquids to the bird 's mouth 32 at the appropriate time. The liquid which is introduced into the mouth may be an electrolyte used to prevent dehydration in shipment, an antibiotic, a vaccine, or any other oral application desired. The fluid supply assembly is not shown in the drawings but comprises an automatic system which squirts the application into the mouth when activated. Two further tubes, 34 and 36, constitute inlet and outlet tubes for a cooling fluid which is provided from a circulatory system, not shown, connecting to the tubes by means of flexible hoses 38. During the operation of the machine, the cooling fluids should be continuously circulated through the hollow bar both for purposes of preventing the bird's mouth from becoming scorched, the result of which is to interfere with the bird's eating habits, and also to prevent heating of the oral application which is often of the type requiring refrigeration and would spoil if exposed in the bar 20 for any length of time without cooling. The bar otherwise will become quite hot due to its repetitive contact with the cauterization blade 14 which is ordinarily red hot.

The accessory is shown in use in FIG. 3 wherein the cauterizing blade 14 is shown in phantom descending against the bird's upper beak member and simultaneously, as indicated by the arrow 40, a dose of vaccine is introduced into the bird's mouth. The activation means for the blade and the vaccine are not shown, but could be operated by a hand or foot control or in one fashion or another by a sensor triggered by the bird's beak itself.

As shown and described herein, the attachment is very simple and, inasmuch as it has no moving parts, is virtually failure-proof and will last indefinitely, as opposed to a similar arrangement wherein movement or other complication is introduced. Additionaly, because of the simplicity of interchanging this attachment with other attachments as, for example, the variable-sized beak holder, a single basic cauterizing unit may be utilized in a number of different capacities without requiring duplication.

I claim:

1. A bird treating apparatus comprising:

a. a frame having a forward end defining a pair of vertical sidewalls;

b. a rigid, hollow bar horizontally extended between said vertical sidewalls, and having a pair of vertical flanges, one being mounted at each end of said bar, said flanges being flush against and rigidly and removably mounted to said vertical sidewalls;

c. a cauterizing blade and means movably mounting same to said frome and parallel to and above to said bar, said blade being operable to descend against bar to trim an upper beak portion extended across said bar;

d. fluid inlet and outlet structure disposed at opposite ends of said bar and circulation means connected thereto to effect the flow of a cooling fluid through said bar;

e. said bar having an injection orifice in the front thereof and including a heat conductive tube entering said bar from the rear, passing through the hollow interior as a bar and terminating in communication with said orifice, whereby a supply of forced fluid solution applied to said tube can be injected into a bird's mouth while the upper beak member thereof is trimmed, the cooling fluid in the bar preventing undue injury to the bird and fluid in use.

2. Structure according to claim 1 wherein said vertical side members and said flanges are provided with mating holes whereby said flanges are removably attachable with wingnuts to said frame such that said bar can be one of a plurality of attachments provided for said trimming machine.

3. A fluid cooled oral application bar and anvil attachment for a chicken beak trimming machine having a frame with a pair of spaced vertical sidewalls and a heated cauterizing blade generally vertically operable between said sidewalk, said attachment comprising:

a. a hollow bar body;

b. said bar having a pair of parallel mounting flanges mounted to the respective ends thereof, said flanges and bar being dimensioned to fit flushly between said sidewalls when horizontally extended, and including means to mount said flanges to said sidewalls such that said bar lies below said blade and serves on an anvil therefor;

c. rigid inlet and outlet tubes mounted adjacent to the ends of said bar for the connection of hoses for the introduction of a flow of cooling fluid through the bar;

d. an orifice in the forward edge of said bar and including a heat conductive tube entering said bar from the rear and passing therethrough into communication with said orifice for the forced introduction of a fluid through said orifice into a bird's mouth.

* * * * *